United States Patent [19]

Muraoka

[11] 4,018,904

[45] Apr. 19, 1977

[54] CONTAINER FOR AN INSTANT FOOD

[75] Inventor: Keiji Muraoka, Nishinomiya, Japan

[73] Assignee: Acecook Co., Ltd., Osaka, Japan

[22] Filed: Nov. 26, 1975

[21] Appl. No.: 635,626

[30] Foreign Application Priority Data

Jan. 21, 1975 Japan ..... 50-10493[U]

[52] U.S. Cl. ..... 426/115; 206/217; 206/497; 215/246; 220/9 R; 220/276; 229/1.5 B; 229/51 TS; 229/DIG. 12; 426/86; 426/122; 426/124

[51] Int. Cl.[2] ..... B65B 29/06; B65B 3/22

[58] Field of Search ..... 220/9 R, 276; 229/1.5 B, 51 TS, 43, DIG. 12; 426/86, 115, 124, 122, 123; 206/497; 215/246

[56] References Cited

UNITED STATES PATENTS

| | | | |
|---|---|---|---|
| 2,666,542 | 1/1954 | Price | 229/51 TS |
| 2,695,744 | 11/1954 | Gattuso | 220/9 R |
| 3,120,900 | 2/1964 | Faulstich | 229/51 TS |
| 3,130,056 | 4/1964 | Taylor et al. | 426/122 |
| 3,186,850 | 6/1965 | Anthony | 426/86 |
| 3,227,273 | 1/1966 | Syverson et al. | 206/497 |
| 3,443,715 | 5/1969 | Edwards | 220/9 R |
| 3,514,029 | 5/1970 | Powell | 206/217 X |
| 3,606,068 | 9/1971 | Palmer | 206/217 X |
| 3,606,262 | 9/1971 | Van't Hoff | 229/1.5 B |
| 3,625,785 | 12/1971 | Holmstrom | 209/1.5 B |
| 3,677,774 | 7/1972 | Rausing | 426/396 X |
| 3,733,002 | 5/1973 | Fujio | 229/DIG. 12 |
| 3,836,063 | 9/1974 | Sutch | 229/1.5 B |
| 3,924,771 | 12/1975 | Cleff | 215/246 |
| 3,976,795 | 8/1976 | Ando | 229/1.5 B X |

FOREIGN PATENTS OR APPLICATIONS

| | | | |
|---|---|---|---|
| 92,388 | 12/1961 | Denmark | 220/9 R |
| 1,912,705 | 10/1969 | Germany | 229/1.5 B |

*Primary Examiner*—Steven L. Weinstein
*Attorney, Agent, or Firm*—Carroll F. Palmer

[57] ABSTRACT

A container for an instant food comprises an outer receptacle and an inner receptacle snugly fitted into the outer receptacle. The inner receptacle has a flange substantially arcuate in cross section and laterally extending beyond the marginal edge of the open end of the outer receptacle. The open end of the container is closed by a covering made of a pliable material.

7 Claims, 6 Drawing Figures

CONTAINER FOR AN INSTANT FOOD

BACKGROUND OF THE INVENTION

I. Field of the Invention

This invention relates to a container for an "instant food" and in particular a double-walled container.

An "instant food" as defined in this specification and claims is intended to mean a dehydrated cooked food which can be rehydrated by a hot water so as to be softened in a refreshed state.

II. Description of prior art

An "instant food" is generally received within a heat insulating container equipped with a covering. The instant food is served by tearing open the covering and pouring hot water into the container so as to be rehydrated in a refreshed state (i.e. be left usually for about 3 minutes). The container by itself is wrapped with a synthetic resin film so as to protect an "instant food" against any possible contamination.

Known as such a container is a type in which two cups made of synthetic resin such as polystyrene are nested one within the other with an air space left in between, thereby offering a heat insulation effect. However, the conventional container has the following disadvantages. Some conventional containers have a sharp (not rounded) marginal edge at the open end. Thus, when a user sips the soup prepared by pouring hot water into the container, the sharp edge comes into contact with the lips of the sipper giving him an unpleasant feeling. As a result, the sipper is not in a pleasant mood. Furthermore, since the marginal edge of the open end of the container has a small contact area with respect to the covering, a positive bond can not be attained with respect to the covering.

SUMMARY OF THE INVENTION

It is accordingly an object of this invention to provide an improved double-walled container for an "instant food" free from the above-mentioned drawbacks.

Another object of this invention is to provide a container wrapped with an easily peelable synthetic resin film.

According to this invention there is provided a double-walled container for an "instant food" which comprises a double-walled structure consisting of a synthetic resin outer receptacle having an open end and closed bottom and including a plurality of ridges circumferentially and intermittently provided on the side wall and projecting outward and a synthetic resin inner receptacle snugly received within the outer receptacle and having an open end and closed bottom and an annular recess at its outer side wall so as to be engaged with a ridge of the outer receptacle, said inner receptacle containing an instant food to be served and including a flange having at the marginal edge portion a flattened portion engaged with the open end of the outer receptacle and circumferentially extending firstly outward in a plane including the open end of the inner receptacle and then downward with a curl at the end of the flange; and a covering made of a pliable substance and adapted to be hermetically sealed to the flattened portion of the flange so as to close the open end of the container; in which an air space is defined between the outer wall of the inner receptacle and the inner wall of the outer receptacle.

DETAILED DESCRIPTION OF THE PREFERRED EMBODIMENT

Figure 1:
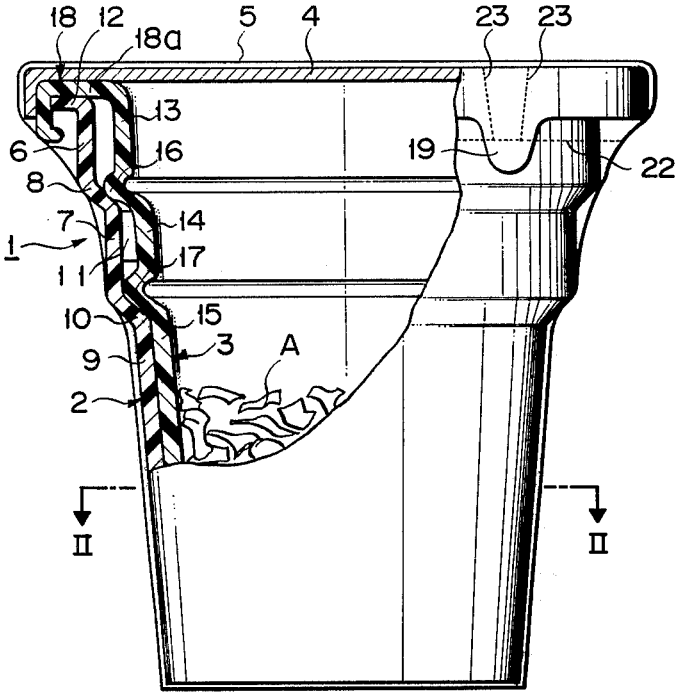
FIG. 1 is a front view, partly in cross section, showing a container according to one embodiment of this invention.

This invention will be explained by reference to the accompanying drawings in which similar reference numerals are employed to designate similar parts or elements throughout the drawings.

In FIG. 1 an "instant food" container 1 according to this invention is constituted by a double-walled structure consisting of an outer receptacle 2 and an inner receptacle 3 snugly received within the outer receptacle 2. The open end of the inner receptacle 3 is covered by a covering 4 and the container 1 as a whole is covered by a sheet of film 5 such as heat-shrinkable polypropylene. The outer receptacle 2 assumes a hollow truncated cone configuration and it is made of synthetic resin, for example, polystyrene which is not deformed by hot water (about 100° C). The small diameter end of the conical configuration is sealed to provide a bottom and the large diameter end of the conical configuration is opened. The outer receptacle 2 has two cylindrical portions 6 and 7 in the neighborhood of the opening of the outer receptacle 2. The cylindrical portion 6 is situated close to the open end of the outer receptacle 2 and has an equal diameter. The cylindrical portion 7 merges with the cylindrical portion 6 through a tapered portion 8 and has a diameter smaller than that of the cylindrical portion 6. The cylindrical portion 7 merges with a remaining truncated cone portion through a tapered portion 10. The cylindrical portion 7 has a plurality of substantially rectangular portions 11 circumferentially and intermittently projected inwardly of the cylindrical portion 7. An outwardly extending flange 12 is formed around the open end of the outer receptacle 2.

The inner receptacle 3 assumes a hollow truncated cone smaller in diameter than the outer receptacle 3 and substantially similar in configuration to the outer receptacle 3. The inner receptacle is also made of synthetic resin such as polystyrene. Like the outer receptacle 2, the inner receptacle 3 has a cylindrical, equal diameter portion 13 close to the opening of the inner receptacle 3 and substantially corresponding to the cylindrical portion 6 of the outer receptacle 2 and a cylindrical, equal diameter portion 14 merging the cylindrical portion 13 through an outwardly projecting annular rib 16 and corresponding to the cylindrical portion 7 of the outer receptacle 2. The cylindrical portion 14 merges with a remaining truncated cone portion 15 through an annular rib 17 similar to the rib 16. The annular rib 16 is engaged with the tapered portion 8 of the outer receptacle 2. The lower surface of the rib 17 is engaged with the tapered portion 10 of the outer receptacle 2. In this way, the cylindrical portion 14 of the inner receptacle 3 exists as a recess or groove between the ribs 16 and 17 and it is engaged with the projections 11 of the outer receptacle 2 to permit the inner receptacle 3 to be snugly fitted into the outer receptacle 2. As a result, the inner receptacle 3 is not easily withdrawn from the outer receptacle 2.

Figure 2:
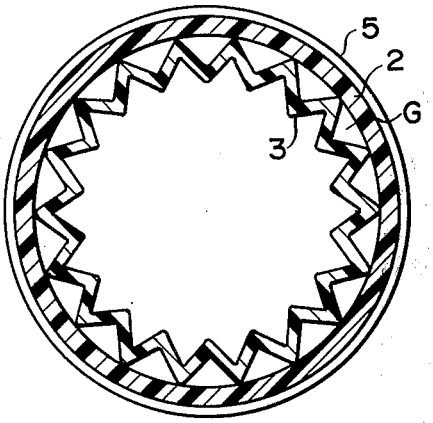
FIG. 2 is a cross-sectional view as taken along line II–II in FIG. 1.

A flange 18 is provided around the open end of the inner receptacle 3 and includes a flattened portion 18a situated in a plane including the open end of the inner receptacle 3. The end of the flange 18 is curled downward. The flattened portion 18a clears, and is engaged with, the marginal edge of the flange 12 of the outer receptacle 3. As a consequence, the flange 18 is engaged with the whole area of the flange 12 of the outer receptacle 2. An air space is provided between the outer wall of the inner receptacle 3 and the inner wall of the outer receptacle 2. The air space, when hot water is poured into the inner receptacle, assures heat insulation between the inner and outer receptacles. With a container according to one embodiment of this invention the cone portion 15 of the inner receptacle 3 is uniformly corrugated as shown in FIG. 2 and each apex of the corrugation is engaged with the inner wall of the outer container 2. Air G is present between each recess of the corrugation and the inner wall of the outer receptacle 2.

Within the inner receptacle 3 is received an "instant food" A which is storable as well as edible as a food by pouring hot water over it so as to cause it to be softened or rehydrated in a refreshed state. For example, fried noodles, meat and vegetable processed by "freeze dry" method are each contained within the container. The covering 4 is a relatively thin sheet made of a pliable substance such as polyethylene film or aluminium foil and it is sealed to the flattened portion 18a of the flange 18 so as to close the open end of the inner receptacle 3. A flap 19 is provided at one side of the periphery of the covering 4 so that the covering 4 is easily peeled off the flange 18 of the inner receptacle 3.

When the "instant food" A is served, the wrap 5 is removed away from the container and the covering 4 is peeled off the flange 18 of the inner receptacle 3. Hot water is poured into the interior of the inner receptacle 3 to cause the food to be softened or rehydrated in a refreshed state. The eater can sip the soup with his lips on the flange 18 of the inner receptacle 3. As mentioned above, the flange 18 of the inner receptacle 3 is engaged with, and well covers, the flange 12 of the outer receptacle 2. Since the flange 18 of the inner receptacle well clears the flange 12 of the outer receptacle 2 and extends downward with a curl left at the end to provide an arcuate portion, the marginal edge portions of the flange 12 and thus the flange 18 permit no direct contact with the lips of the eater. Since only the outer arcuate side surface of the flange 18 permits a contact with the lips of the eater, it is good to the touch and any unpleasant feeling is not given to the eater. Furthermore, soup does not drip through the flange 18 of the inner receptacle. The flattened portion **18*a* of the flange 18 has a wide contact area and, therefore, the covering 4 can be positively sealed to the flattened portion 18*a* of the flange 18.**

Figure 3:
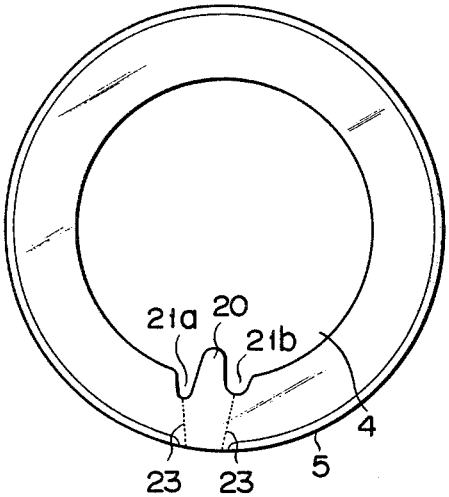
FIG. 3 is a plan view showing the container of FIG. 1 on a small scale.

The wrap 5 may cover the whole surface of the container 1, but as shown in FIG. 3 it may cover the marginal edge portion of the covering 4 with a central circular area of the covering left unwrapped. The wrap 5 covers the marginal edge portion of the covering 4 to leave an unwrapped central circular portion. A tear-off flap 20 extends toward the center of the covering 4 and it is used to remove the wrap 5 from the outer receptacle 2 and covering 4. A cutout (**21*a*, 21*b*) is provided at each side of the base portion of the tear-off flap 20. One cutout 21*a* is different in depth and width from the other cutout 21*b*. A perforation line 22 is circumferentially provided in the wrap 5 in a position short of the open end of the outer receptacle 2. A pair of perforation lines 23, 23 is formed in the wrap 5 and extends straight from the corresponding cutouts 21*a* and 21*b* to the perforation line 22.** This permits the upper wrap portion to be easily peeled off the upper portion of the container.

The wrap 5 is removed from the container as follows. When the tear-off flap 20 is outwardly pulled away from the center of the covering 4, the flap is torn off along the perforation lines 23, 23 and the upper wrap portion is also torn off along the perforation line 22 to expose the upper portion of the container. In this case, the tear-off portion is removed across the upper wrap portion and, then, the upper wrap portion is torn off, in a circumferential direction of the outer receptacle, along the perforation line 22. The covering 4 is peeled off the marginal edge portion of the outer receptacle 2 to expose the open end of the container. Since in this case the cutouts **21*a* and 21*b* are formed one at each side of the base portion of the flap 20, when the flap 20 is pulled outwardly, a tearing force is given along the perforation lines 23, 23 through the cutouts 21*a*, 21*b* and the flap can be torn off by a slight pulling force. As one cutout 21*a* is made deeper than the other cutout 21*b*, the distance of one perforation line 23 down to the perforation line 22 is shortened by that extent when a tear-off is effected. Furthermore, the tear-off is effected firstly along the perforation line 23 associated with the shallower cutout 21*b* and a slight force necessary for one perforation line 23 to be torn is only required as compared with the case where the tear-off is simultaneously started from both the sides of the base portion of the flap 20 i.e. from both the cutouts 21*a* and 21*b*. Since the tear-off is effected firstly from the shallower cutout 21*b* the flap 20** is somewhat twisted at a certain angle and some rotation force is imparted to a tearing movement. As a consequence, an easy tear-off can be positively made without effort.

Where hot water is poured into the "instant food" within the container, for example, a soup is prepared or the food is seasoned with a condiment such as a sauce after the hot water is poured out. In any case, a thorough agitation is required in uniformly flavouring the refreshed food. I found that, if the bottom of the inner receptacle 3 is made "substantially arcuate" in cross section, agitation can be smoothly effected after the "instant food" A is softened or rehydrated, by a hot water, in a refreshed state. The "substantially arcuate" as defined in this specification is intended to mean an angle relatively greater than 90° when it is measured between the bottom wall and side wall of the inner receptacle.

Figure 4:
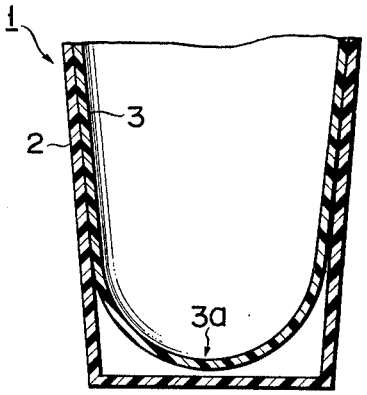
FIG. 4 is a cross-sectional view showing part of a container according to another embodiment of this invention.

In FIG. 4 the bottom **3*a* of the inner receptacle 3** is hemispherical in shape i.e. semicircular in cross section. The bottom configuration permits a noodle etc. to be smoothly agitated at the hemispherical bottom of the inner receptacle without any local crowding of a sauce. The so prepared food is readily edible without crowding any gradients.

Figure 5:
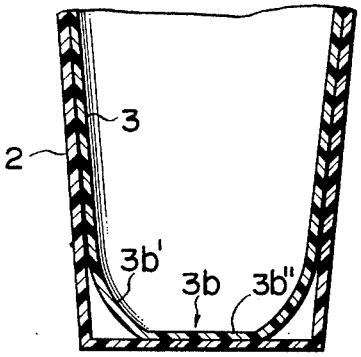
FIG. 5 is a cross-sectional view showing part of a container according to another embodiment of this invention.

In FIG. 5 a bottom 3*b* of the inner receptacle 3 consists of a spherical portion 3*b'* and flattened portion 3*b''*. The spherical portion 3*b'* of the bottom of the inner receptacle is substantially arcuate in cross section. The radius of the spherical portion 3*b'* is made relatively great and no sauce or condiments are locally crowded.

Figure 6:
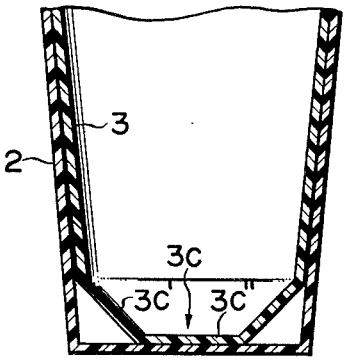
FIG. 6 is a cross-sectional view showing part of a container according to another embodiment of this invention.

A bottom 3*c* of the inner receptacle as shown in FIG. 6 assumes a truncated cone configuration.

What is claimed is:

1. A double-walled container for instant food comprising:

an outer receptacle of synthetic resin including a smooth peripheral side wall and having an open top and a closed bottom with two cylindrical portions near the open top of the outer receptacle; said cylindrical portions merging with each other through a tapered portion and the lower of the cylindrical portions merging with the remaining part of the receptacle by a second tapered portion;

said lower cylindrical portion having a plurality of inward projections formed circumferentially at intervals on the peripheral side wall of the outer receptacle, adjacent but spaced from said open top of the outer receptacle;

an inner receptacle of synthetic resin containing therein instant food, the inner receptacle including a lower corrugated peripheral side wall and having a closed bottom and a brim substantially flush with the open top of the outer receptacle, the apex of each corrugation being in contact with the peripheral side wall of the outer receptacle below said second tapered portion and forming an air space between the outer and inner receptacles;

two parallel annular ribs formed on the inner receptacle above the corrugated peripheral side wall, adjacent but spaced from said brim of the inner receptacle and defining therebetween an annular groove receiving said inward projections of the outer receptacle, thereby holding the inner receptacle within the outer receptacle; said ribs engaging said tapered portions;

a flange formed on and around said brim of the inner receptacle and extending outwards beyond the open top of the outer receptacle in a plane including the brim of the inner receptacle, the free end of the flange being curled downward and spaced from the outer surface of the outer receptacle; and a covering of a pliable material bonded to said flange, thereby sealing said instant food within said inner receptacle.

2. The container according to claim 1, in which the body of said inner and outer receptacles assumes a hollow truncated cone configuration.

3. The container according to claim 1 wherein said covering includes a flap at its periphery.

4. The container according to claim 2, further including a heat-shrinkable film wrapping the container.

5. The container according to claim 4, in which said inner receptacle has a substantially hemispherical bottom.

6. The container according to claim 4, in which said inner receptacle has a truncated cone bottom configuration greater in angle than the body of said inner receptacle.

7. The container according to claim 4 wherein said film wraps all the outer surface of the container and the marginal edge portion of the covering except for a circular central portion of said covering, said film having a perforation line in the circumferential direction in a portion of the film which wraps the outer surface of the container and a tear-off flap provided in said film over said covering projecting toward the center of the covering, said flap has at its base a pair of cutouts different in depth and width from each other, said paired cutouts leading into perforated lines that extend over the top and down onto the side of the film where said perforated lines meet and intersect with said circumferential perforation line.

* * * * *